US008454392B2

(12) United States Patent
Sulem et al.

(10) Patent No.: US 8,454,392 B2
(45) Date of Patent: Jun. 4, 2013

(54) SYSTEM AND METHOD FOR COUPLING A PORTABLE ELECTRONIC DEVICE TO A CHARGING/ DATA POD

(75) Inventors: Firmansyah Kuncoko Sulem, Waterloo (CA); Felipe Oliveira Simoes, Kitchener (CA); Raymond Michael Dikun, Conestogo (CA)

(73) Assignee: Research In Motion Limited, Waterloo, Ontario (CA)

( * ) Notice: Subject to any disclaimer, the term of this patent is extended or adjusted under 35 U.S.C. 154(b) by 344 days.

(21) Appl. No.: 12/772,715

(22) Filed: May 3, 2010

(65) Prior Publication Data

US 2011/0269349 A1 Nov. 3, 2011

(51) Int. Cl.
*H01R 25/00* (2006.01)

(52) U.S. Cl.
USPC ..... 439/638; 439/929

(58) Field of Classification Search
USPC ..... 439/638, 929; 361/679.4–679.45
See application file for complete search history.

(56) References Cited

U.S. PATENT DOCUMENTS

| | | | | |
|---|---|---|---|---|
| 6,315,582 | B1 | 11/2001 | Nishio et al. | |
| 6,457,996 | B1 | 10/2002 | Shih | |
| 7,381,095 | B2 * | 6/2008 | Freeman et al. | 439/638 |
| 2002/0115480 | A1 * | 8/2002 | Huang | 455/573 |
| 2003/0017746 | A1 | 1/2003 | Lee | |
| 2007/0178771 | A1 | 8/2007 | Goetz et al. | |
| 2007/0232098 | A1 | 10/2007 | Danner | |
| 2008/0150480 | A1 | 6/2008 | Navid | |
| 2009/0236140 | A1 | 9/2009 | Randall | |
| 2010/0022285 | A1 | 1/2010 | Randall et al. | |

FOREIGN PATENT DOCUMENTS

DE 20105781 U1 6/2001

OTHER PUBLICATIONS http://goitworld.blogspot.com/2008_08_01_archive.html; Aug. 3, 2010; 37 pgs.
http://www.uxcell.com/usb-charger-cradle-with-adapter-for-htc-touchdiamond-plug-p-23734.html; Aug. 3, 2010; 2 pgs.
Universal Serial Bus Specification; Revision 1.1; Sep. 23, 1998; 327 pgs.
Universal Serial Bus Specification; Revision 2.0; Apr. 27, 2000; Part 1; 321 pgs.
Universal Serial Bus Specification; Revision 2.0; Apr. 27, 2000; Part 2; 329 pgs.
Universal Serial Bus Specification 3.0; Revision 1.0; Nov. 12, 2008; 482 pgs.
EPO Search and Examination Report; EP Patent Application No. 100046390; Oct. 14, 2010; 8 pgs.
European Examination Report; Application No. 10004639.0; Jan. 24, 2012; 3 pages.
European Examination Report; Application No. 10004639.0; Aug. 28, 2012; 5 pages.

* cited by examiner

*Primary Examiner* — Briggitte R Hammond
(74) *Attorney, Agent, or Firm* — Conley Rose, P.C.; J. Robert Brown, Jr.

(57) ABSTRACT

An adaptor is provided. The adaptor comprises a first portion including a plug insertable into a port of a portable electronic device. The adaptor further comprises a second portion including at least one adaptor contact configured such that, when the plug of the first portion is inserted into the port and the portable electronic device is placed in a pod, the at least one adaptor contact abuts to at least one pod contact in the pod.

10 Claims, 7 Drawing Sheets

SYSTEM AND METHOD FOR COUPLING A PORTABLE ELECTRONIC DEVICE TO A CHARGING/ DATA POD

BACKGROUND

Easily transportable electronic devices such as telephones, personal media players, cameras, game consoles, personal digital assistants, and the like will be referred to herein as portable electronic devices. Some portable electronic devices can be inserted into a pod, a cradle, a charging station, or a similar base structure through which an electrical charge might be delivered to the portable electronic device and/or data might be transferred to or from the portable electronic device. Any such base structure will be referred to herein as a pod. A portable electronic device may couple to a pod via one or more well known interfaces, such as USB (Universal Serial Bus). The discussion herein will focus on USB, but it should be understood that the embodiments disclosed herein are equally applicable to other interfaces. As used herein, the term "USB" might refer to devices, cables, connectors, or other components that comply with any past, current, or future USB standard, version, or configuration, such as USB 1.0, USB 2.0, USB 3.0, mini-USB, micro-USB, or others, and all such possibilities are contemplated by the embodiments disclosed herein.

Also, as used herein, the terms "couple", "couples", and the like might refer to a direct connection without any intervening entities between two coupled components or to an indirect connection where one or more entities intervene between two coupled components. Coupling might be achieved, for example, by inserting one component into another or by abutting one component with another. When two conductive components are coupled, electrical energy and/or data can be transferred between the two components.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments of the present disclosure are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Embodiments of the present disclosure provide methods and mechanisms for coupling a portable electronic device to a pod. More specifically, an adaptor is provided that can be inserted into and couple to a port on a portable electronic device. When the adaptor is inserted into the portable electronic device and the portable electronic device is placed in a pod, a contact on the adaptor can abut and couple to a contact on the pod. Electrical energy and/or data can then be transferred between the pod and the portable electronic device via the adaptor.

Such an adaptor might allow a portable electronic device to receive a charge from and/or exchange data with a pod with which the portable electronic device might not otherwise be able to couple. For example, a pod might include an exposed conductive surface or contact for charging and/or exchanging data with portable electronic devices but might not include a USB plug. On the other hand, a portable electronic device might include a USB port but might not include an exposed conductive surface or contact that can abut the exposed contact on the pod. When the adaptor is inserted into the USB port on such a portable electronic device, a plug portion of the adaptor can couple with the USB port and a non-plugging portion of the adaptor can abut to the exposed contact on the pod. The USB port and the contact on the pod can then be coupled through the adaptor.

As used herein, the terms "plug" and the like refer to the male portion of a typical male/female-type connection or configuration. The terms "abut" and the like refer to non-plugging physical contact without the typical male/female-type connection or configuration. However, it should be understood that abutment might include contact wherein one contacting surface slightly protrudes and another contacting surface slightly recedes.

Figure 1:
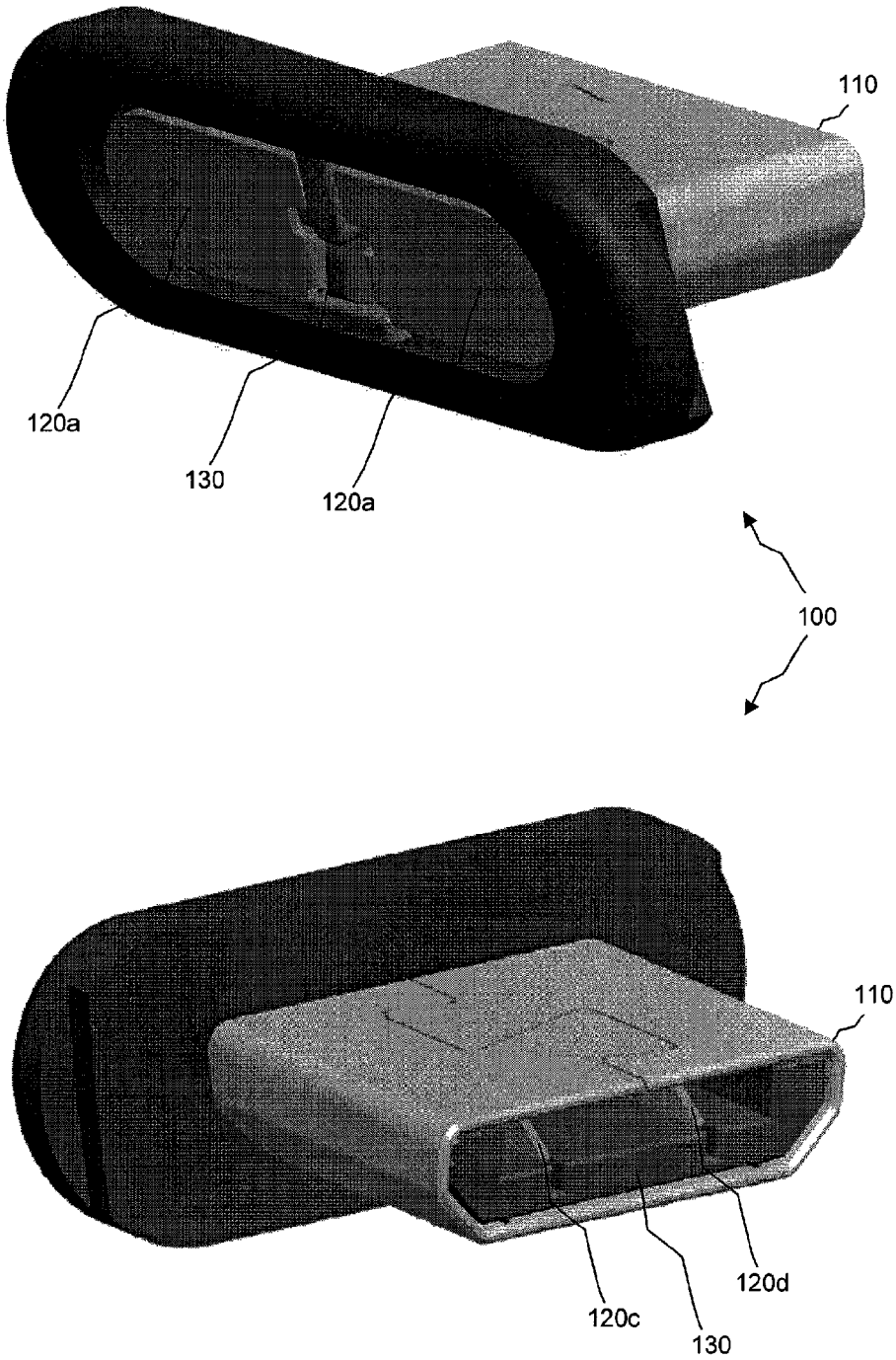
FIG. 1 illustrates an example of a specific adaptor, according to an embodiment of the disclosure.

FIG. 1 illustrates front and rear views of an example of a specific embodiment of such an adaptor 100. FIG. 2 illustrates examples of generic embodiments of an adaptor 100 and will be described below. One side of the adaptor 100 includes a plug 110 that can be inserted into a port on a portable electronic device. In the embodiment of FIG. 1, the plug 110 is configured to fit into a USB port, but in other embodiments, the plug 110 might be configured to fit into other types of ports. Another side of the adaptor 100 includes an electrically conductive surface, which will be referred to herein as the adaptor contact 120. In the embodiment of FIG. 1, the adaptor contact 120 consists of two surfaces 120*a* and 120*b* separated by an insulating material 130, but in other embodiments, the adaptor contact 120 could include only one surface or more than two surfaces. The surfaces of the adaptor contact 120 might allow the transmission of electrical energy, data, or both. For example, the adaptor contact 120 could be configured with four surfaces for a USB-type application, wherein one surface of the adaptor contact 120 is a positive electrical contact, one surface of the adaptor contact 120 is a negative electrical contact, and two surfaces of the adaptor contact 120 are data contacts.

In some embodiments, the adaptor 100 might include portions 120*c* and 120*d* of the adaptor contact 120 extending through the plug 110 such that, when the adaptor 100 is inserted into the port of the portable electronic device, those portions 120*c* and 120*d* can make electrical contact with at least one contact within the port. A contact within the port on the portable electronic device will be referred to herein as a port contact. In other cases, portions of the adaptor contact 120 may not extend through the plug 110 and, instead, connectors may be present in or about the plug 110 to couple the adaptor contact 120 to one or more port contacts. In any case, an insulating material may be present within the plug 110 to support and separate portions of the adaptor contact 120 or the connectors. When the plug 110 is electrically conductive, the insulating material might also shield the adaptor contact 120 or the connectors from the plug 110. This insulating material might be the same as the insulating material 130 that separates the portions 120*a* and 120*b* of the adaptor contact 120 and the portions 120*c* and 120*d* of the adaptor contact 120.

Figure 2A:
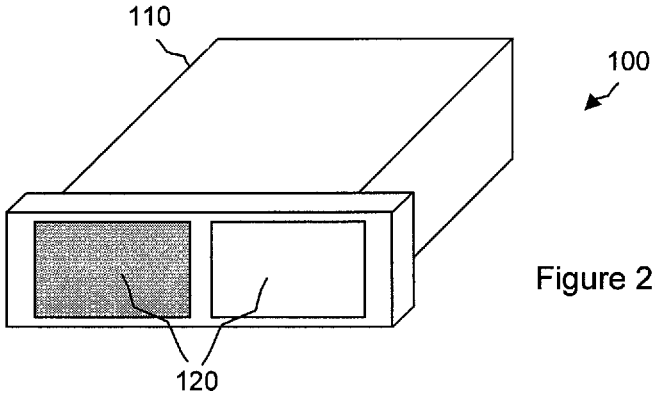
FIGS. 2*a*, 2*b*, and 2*c* illustrate examples of generic adaptors, according to embodiments of the disclosure.
Figure 2B:
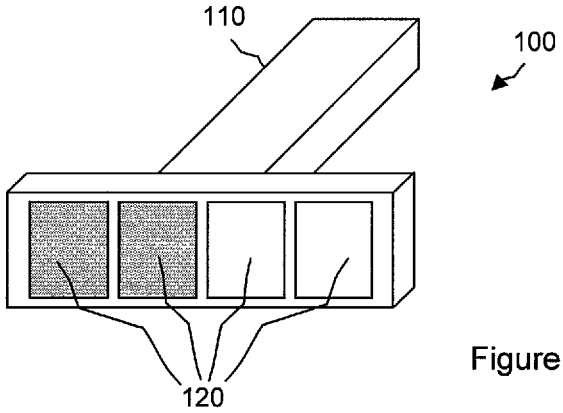
Figure 2C:
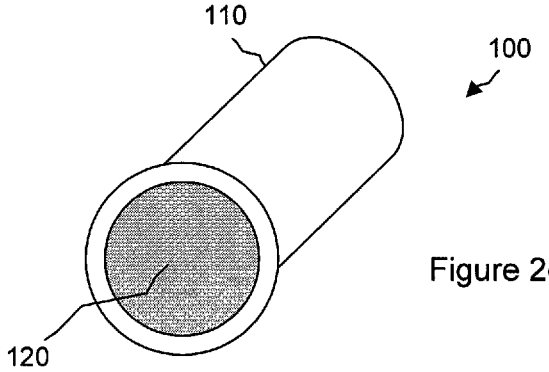

FIGS. 2*a*, 2*b*, and 2*c* illustrate examples of embodiments of generic adaptors 100. These examples are intended to depict some possible configurations of the adaptor 100, but other configurations are contemplated under other embodiments. Despite the different configurations, all the embodiments comprise an adaptor 100 with a plug 110 on one side and at least one non-protruding contact 120 on the other side, and all the embodiments can provide a similar mode of operation. In FIG. 2*a*, the plug portion 110 of the adaptor 100 is rectangular and relatively wide compared to the width of the entire adaptor 100, and two rectangular adaptor contacts 120 are present. In FIG. 2*b*, the plug portion 110 of the adaptor 100 is rectangular and relatively narrow compared to the width of the entire adaptor 100, and four rectangular adaptor contacts 120 are present. In FIG. 2*c*, the plug portion 110 of the adaptor 100 is cylindrical, and a single circular adaptor contact 120 is present. One of skill in the art will recognize that other sizes or shapes of the plug 110 could be present and that other numbers, sizes, or shapes of the adaptor contacts 120 could be present. In particular, when the adaptor 100 is intended for USB applications, the plug 110 might be configured accordingly to conform to various USB standards. In other non-USB embodiments, the plug 110 might be configured differently.

Figure 3:
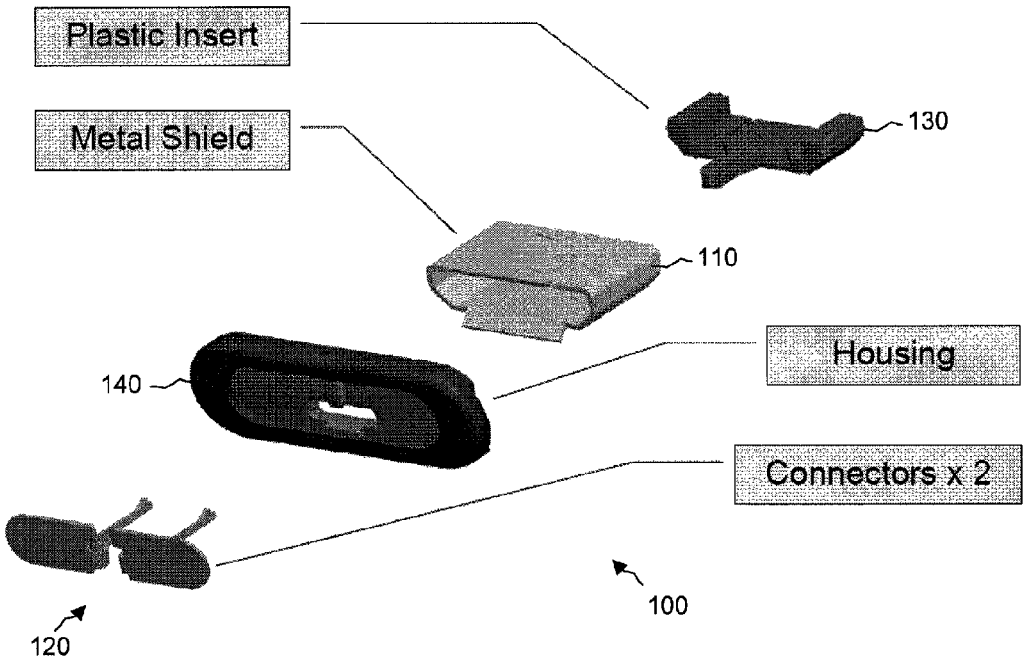
FIG. 3 illustrates an expanded view of an adaptor, according to an embodiment of the disclosure.
Figure 4:
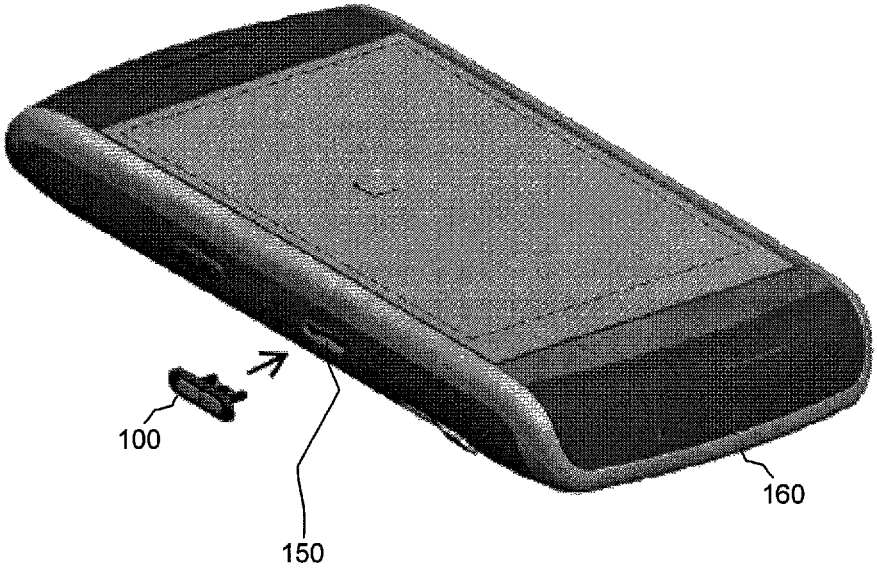
FIG. 4 illustrates insertion of an adaptor into a portable electronic device, according to an embodiment of the disclosure.

FIG. 3 illustrates an expanded view of one embodiment of the adaptor 100. The components and configuration of the illustrated embodiment of the adaptor 100 are generally suited for USB-type applications, but the components could be differently configured for other applications or connections. In this embodiment, the plug 110 comprises a metal shield into which the adaptor contact 120 and the insulating material 130 can be inserted. A housing 140 mates with the plug 110, adaptor contact 120, and insulating material 130. When the plug 110, adaptor contact 120, insulating material 130, and housing 140 are assembled as shown in FIGS. 1 and 4, the adaptor 100 can be inserted into a port 150 in a portable electronic device 160. The adaptor 100 can then allow at least a portion of the adaptor contact 120 to couple to at least one port contact in the port 150. The port contacts are not shown in FIG. 4 but might be standard USB-type port contacts. In the embodiment of FIG. 4, the port 150 is located on the side of the portable electronic device 160, but in other embodiments, the port 150 could be located elsewhere on the portable electronic device 160.

In an alternative embodiment, the plug 110, insulating material 130, and housing 140 might be a single, non-conductive unit in which the conductive adaptor contact 120 is embedded. In this embodiment, the single, non-conductive unit might be shaped to fit into a port, such as the USB port 150, on the portable electronic device 160, and the adaptor contact 120 might be positioned within the single, non-conductive unit such that the adaptor contact 120 can couple to one or more port contacts in the port 150.

Figure 5:
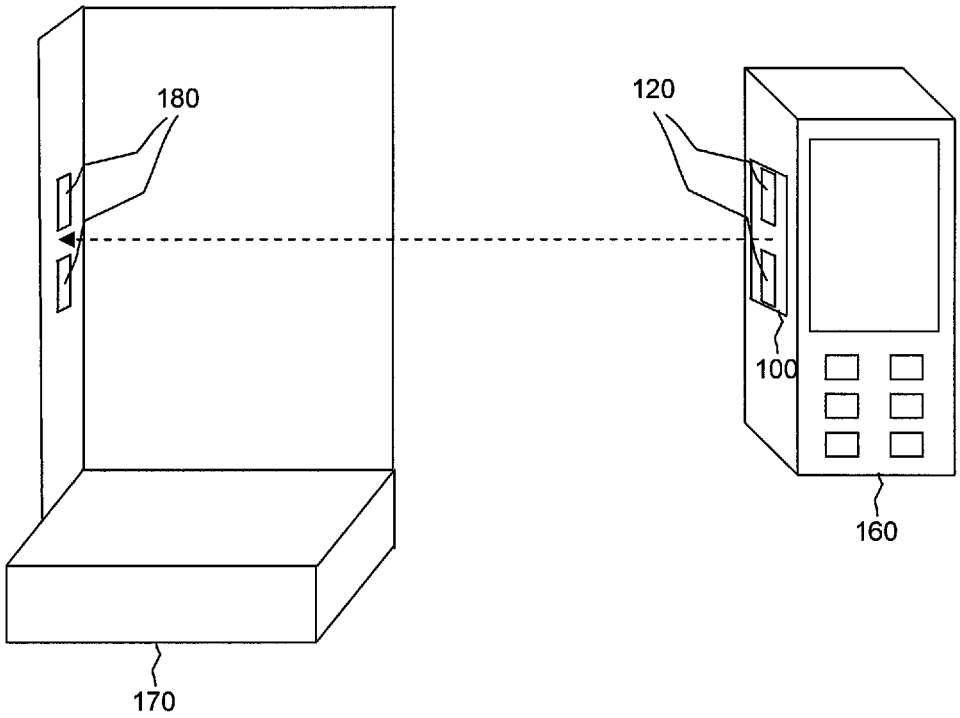
FIG. 5 illustrates placement of a portable electronic device in a pod, according to an embodiment of the disclosure.

When the adaptor 100 is inserted into the port 150, and the portable electronic device 160 is placed in a pod 170, as illustrated in FIG. 5, the adaptor contact 120 abuts at least one contact point 180 in the pod 170. The contact points 180 in the pod 170 may also be referred to herein as pod contacts 180. In the illustrated embodiment, the pod 170 includes two pod contacts 180, but in other embodiments, other numbers of pod contacts 180 could be present. In an embodiment, the adaptor 100 is designed such that the size and shape of the adaptor contact 120 is approximately the same as the size and shape of the pod contacts 180. That is, since there are two pod contacts 180, the adaptor 100 is designed with two portions 120*a* and 120*b* of the adaptor contact 120 that have an appropriate size and shape so as to abut the pod contacts 180 when the portable electronic device 160 is positioned in the pod 170. In addition, the adaptor 100 has a sufficiently low profile that, when the adaptor 100 is inserted into the portable electronic device 160, the portable electronic device 160 can fit in the pod 170. The abutment of the adaptor contact 120 with the pod contacts 180 and the coupling of the adaptor contact 120 with the port contacts allow data and/or electrical energy to be transferred between the pod contacts 180 and the port contacts, and thus between the pod 170 and the portable electronic device 160.

Figure 7:
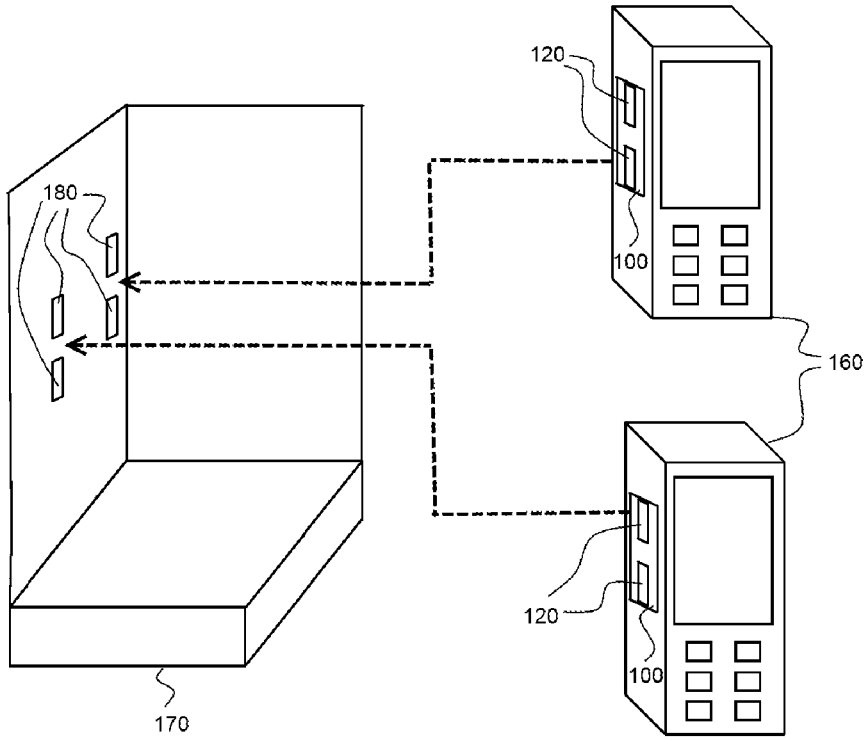
FIG. 7 illustrates placement of a plurality of portable electronic devices in a pod, according to an embodiment of the disclosure.

In FIG. 7, the pod 170 may include a plurality of sets of pod contacts 180, and a plurality of portable electronic devices 160 could be placed in the pod 170 simultaneously. An adaptor 100 may be inserted in each of the plurality of portable electronic devices 160, such that each of the adaptors 100 in the plurality of portable electronic devices 160 may abut with one of the sets of pod contacts 180. For example, the pod 170 of FIG. 7 is shown with a plurality of sets of two pod contacts 180, one of which may provide a positive voltage and the other of which may be at a ground voltage, such that a portable electronic device 160 placed in contact with the pod contacts 180 can be recharged. A plurality of such sets of pod contacts 180 may be present in the pod 170, and one pod contact 180 of each set may have a voltage and the other may be at ground. A plurality of portable electronic devices 160 may be placed in such a pod 170 at the same time, and each of the portable electronic devices 160 may be charged by the pod 170 if the portable electronic devices 160 included adaptors 100 to create an appropriate interface between the portable electronic devices 160 and the pod contacts 180.

The capability of coupling the portable electronic device 160 to the pod 170 in the abutting manner described above can eliminate the need to include on the pod 170 a protruding plug that can be inserted into the port 150. The absence of such a protruding plug, in turn, can eliminate the possibility that a user of the portable electronic device 160 will accidentally break the protruding plug off from the pod 170 or otherwise damage such a connection when removing the portable electronic device 160 from the pod 170. When the adaptor 100 is removed from the port 150, the port 150 can be used to connect a cable, such as a USB cable, to the portable electronic device 160. The adaptor 100 might allow a portable electronic device 160 to easily adapt to other types of pods, cradles, or chargers and might be provided with such components at the point of sale.

Figure 6:
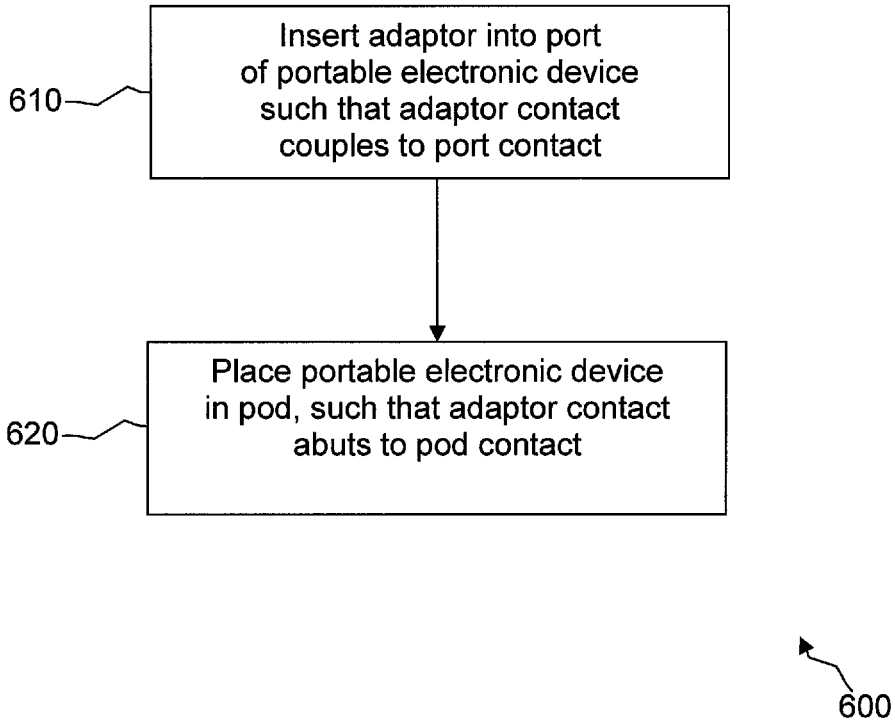
FIG. 6 illustrates a method for coupling a portable electronic device to a pod, according to an embodiment of the disclosure.

FIG. 6 illustrates an embodiment of a method 600 for coupling a portable electronic device to a pod. At block 610, an adaptor is inserted into a port of the portable electronic device such that an adaptor contact couples to a port contact. At block 620, the portable electronic device is placed in the pod such that the adaptor contact abuts to a pod contact.

In an embodiment, an adaptor is provided. The adaptor includes a first portion including a plug insertable into a port of a portable electronic device. The adaptor further includes a second portion including at least one adaptor contact configured such that, when the plug of the first portion is inserted into the port and the portable electronic device is placed in a pod, the at least one adaptor contact abuts to at least one pod contact in the pod.

In another embodiment, a method is provided for coupling a portable electronic device to a pod. The method comprises inserting an adaptor into a port of the portable electronic device, such that at least one adaptor contact in the adaptor couples to at least one port contact in the port. The method further comprises placing the portable electronic device in the pod, such that the at least one adaptor contact abuts to at least one pod contact in the pod.

In another embodiment, a system is provided that includes at least one of a portable electronic device and a pod. The system also includes an adaptor. The adaptor includes a first portion having a plug insertable into a port of the portable electronic device and a second portion not having a plug and having at least one adaptor contact configured such that, when the plug is inserted into the port and the portable electronic device is placed in the pod, the at least one adaptor contact couples to at least one pod contact in the pod and to at least one port contact in the port.

The following are incorporated herein by reference for all purposes: Universal Serial Bus Specification 1.0.1, Universal Serial Bus Specification 2.0, and Universal Serial Bus Specification 3.0.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

Also, techniques, systems, subsystems and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A system comprising:

at least one of a portable electronic device and a pod; and an adaptor comprising a first portion having a plug insertable into a port of the portable electronic device and a second portion not having a plug and having at least one adaptor contact configured such that, when the plug of the first portion is inserted into the port and the portable electronic device is placed in the pod, the at least one adaptor contact couples to at least one pod contact in the pod and to at least one port contact in the port and connects the at least one adaptor contact to the at least one pod contact and to the at least one port contact to enable a transfer of electrical energy to the portable electronic device, wherein the pod has a plurality of pod contacts such that, when a plurality of adaptors are inserted into the ports of a plurality of portable electronic devices, the plurality of portable electronic devices can be placed in the pod such that the plurality of adaptors abut the plurality of pod contacts.

2. The system of claim 1, wherein, via the coupling of the at least one adaptor contact to the at least one pod contact and to the at least one port contact, a transfer of data can occur.

3. The system of claim 1, wherein the coupling of the at least one adaptor contact to the at least one pod contact is achieved via abutment of the at least one adaptor contact with the at least one pod contact, without insertion of a male portion of the pod into the portable electronic device and without insertion of a male portion of the adaptor into the pod.

4. The system of claim 1, wherein the second portion has a profile such that, when the plug is inserted into the port, the portable electronic device can physically fit into the pod.

5. The system of claim 1, wherein the port of the portable electronic device is a Universal Serial Bus (USB) port.

6. A method for coupling a portable electronic device to a pod, comprising:

inserting an adaptor into a port of the portable electronic device, such that at least one adaptor contact in the adaptor couples to at least one port contact in the port; and placing the portable electronic device in the pod, such that the at least one adaptor contact abuts to at least one pod contact in the pod to connect the at least one adaptor contact to the at least one pod contact and to the at least one port contact and enable a transfer of electrical energy to the portable electronic device, wherein the pod has a plurality of pod contacts such that, when a plurality of adaptors are inserted into the ports of a plurality of portable electronic devices, the plurality of portable electronic devices can be placed in the pod such that the plurality of adaptors abut the plurality of pod contacts.

7. The method of claim 6, wherein, via the coupling of the at least one adaptor contact to the at least one pod contact and to the at least one port contact, a transfer of data can occur.

8. The method of claim 6, wherein the abutment of the at least one adaptor contact to the at least one pod contact is achieved via a non-plugging abutment, without insertion of a male portion of the pod into the portable electronic device and without insertion of a male portion of the adaptor into the pod.

9. The method of claim 6, wherein the adaptor has a profile such that, when the adaptor is inserted into the port, the portable electronic device can physically fit into the pod.

10. The method of claim 6, wherein the port of the portable electronic device is a Universal Serial Bus (USB) port.

* * * * *